US006532762B2

(12) United States Patent
Smith et al.

(10) Patent No.: US 6,532,762 B2
(45) Date of Patent: Mar. 18, 2003

(54) REFRIGERATION COOLING DEVICE WITH A SOLID SORBENT

(75) Inventors: Douglas Smith, Albuquerque, NM (US); Kevin Roderick, Albuquerque, NM (US); Robert Braun, Albuquerque, NM (US)

(73) Assignee: Thermal Products Development, Inc., West Hollywood, CA (US)

( * ) Notice: Subject to any disclaimer, the term of this patent is extended or adjusted under 35 U.S.C. 154(b) by 0 days.

(21) Appl. No.: 10/184,344

(22) Filed: Jun. 26, 2002

(65) Prior Publication Data

US 2002/0166335 A1 Nov. 14, 2002

Related U.S. Application Data

(62) Division of application No. 09/691,436, filed on Oct. 18, 2000.

(51) Int. Cl.[7] ..... F25B 17/00; F25B 17/08

(52) U.S. Cl. ..... 62/480; 62/106

(58) Field of Search ..... 62/480, 482, 483, 62/486, 487, 478, 457.9, 112, 106; 165/104.12

(56) References Cited

U.S. PATENT DOCUMENTS 4,736,599 A * 4/1988 Siegel ..... 62/294
5,014,517 A * 5/1991 Larin et al. ..... 62/55.5
5,018,368 A * 5/1991 Steidl et al. ..... 62/480
5,291,942 A * 3/1994 Ryan ..... 165/104.12
5,477,705 A * 12/1995 Meunier ..... 62/480
5,477,706 A * 12/1995 Kirol et al. ..... 62/480
5,660,049 A * 8/1997 Erickson ..... 62/107

* cited by examiner

*Primary Examiner*—Denise L. Esquivel
*Assistant Examiner*—Melvin Jones
(74) *Attorney, Agent, or Firm*—Gordon & Rees, LLP; Marc E. Hankin; Brian D. Wichner

(57) ABSTRACT

Disclosed is a liquid refrigerant reservoir and a cooling device comprised of at least one sorbent section, at least one liquid passageway section, at least one wicking material, at least one thermal spacer, a vapor-permeable membrane, a heat-removing material, at least one liquid barrier, a liquid refrigerant reservoir, and a valve. The sorbent section contains a sorbent for a liquid refrigerant. The liquid passageway section is adjacent the sorbent section and defines a liquid passageway through a portion of the evacuated sorbent assembly and cooling device to the sorbent section. The wicking material is disposed in the liquid passageway section. The thermal spacer is in contact with the sorbent section. The vapor-permeable membrane is interposed between the liquid passageway section and the thermal spacer. The heat-removing material is in thermal contact with the sorbent. The liquid barrier is interposed between the heat-removing material and the sorbent. The liquid refrigerant reservoir is adjacent the liquid passageway section. The valve controls liquid communication between the liquid passageway section and the liquid refrigerant reservoir. The cooling device includes a casing that surrounds the sorbent section, liquid passageway section, wicking material, thermal spacer, vapor-permeable membrane, heat-removing material, liquid barrier, liquid refrigerant reservoir, and valve.

12 Claims, 5 Drawing Sheets

REFRIGERATION COOLING DEVICE WITH A SOLID SORBENT

DIVISIONAL APPLICATION

This application is a divisional of application Ser. No. 09/691,436, filed on Oct. 18, 2000, which claims the previously unelected group of claims in that application from which the elected group of claims now has issued as U.S. Pat. No. 6,438,992, on Aug. 27, 2002.

BACKGROUND OF THE INVENTION

1. Field of the Invention

The present invention relates to the mechanical arts. In particular, the present invention relates to an adsorbent-driven cooling device.

2. Discussion of the Related Art

There have been many attempts to manufacture an inexpensive, lightweight, compact cooling device that employs an adsorbent to adsorb a liquid refrigerant such as water. In such a cooling device, there are typically two chambers, one housing the adsorbent and the other housing the liquid refrigerant, in thermal contact with the medium to be cooled. To achieve an effective cooling action, both the adsorbent chamber and the liquid refrigerant chamber must be evacuated. The adsorbent chamber, in particular, must have a substantial vacuum condition (evacuated to less than $8\times10^{-4}$ mm Hg). When communication is opened between the two chambers, some of the liquid refrigerant is caused to vaporize and flow into the adsorbent chamber, where the vapor is adsorbed by the adsorbent. The latent heat of vaporization causes heat to be removed from the media adjacent the liquid. The adsorption of the vapor causes additional liquid to be vaporized, thus further continuing the cooling process.

One particular application for which adsorbent-driven cooling devices have been considered is for the rapid chilling of a beverage. One such device is described in U.S. Pat. No. 4,928,495. This patent describes a self-contained cooling device in which a cooling effect is produced by causing a liquid refrigerant to evaporate in a chamber within a beverage container and in the process absorb heat from its surroundings. The resulting refrigerant vapor is then adsorbed by an adsorbent housed in a chamber located outside of the beverage container. While this device may act to cool a beverage placed within the container, the difficulties and costs associated with manufacturing a beverage container with an external adsorbent chamber are a significant impediment to mass production of such containers. In addition, with this arrangement, the path in which the vaporized liquid must travel before it is adsorbed by the adsorbent is long, which prevents the cooling device, from adequately cooling the beverage within a commercially acceptable amount of time.

Accordingly, it should be recognized that there remains a need for an evacuated sorbent assembly and cooling device that is easy and inexpensive to manufacture, is compact and lightweight, and has a short vapor path while providing effective cooling characteristics. The present invention satisfies these and other needs and provides further related advantages.

SUMMARY OF THE INVENTION

The invention resides in an evacuated sorbent assembly and cooling device that provide advantages over known adsorbent-driven cooling devices in that the invention is easy and inexpensive to manufacture. Also, the invention is compact and lightweight, and has a short vapor path. Additionally, the invention provides effective cooling characteristics.

The present invention is embodied in an evacuated sorbent assembly for coupling to a liquid refrigerant reservoir and a cooling device comprised of at least one sorbent section, at least one liquid passageway section, and a valve. The sorbent section contains a sorbent for a liquid refrigerant. The liquid passageway section is adjacent the sorbent section and defines a liquid passageway through a portion of the evacuated sorbent assembly or cooling device to the sorbent section. The liquid passageway contains wicking material of an amount sufficient to prevent the liquid refrigerant from contacting the sorbent. The valve controls liquid communication between the liquid passageway section and the liquid refrigerant reservoir. In another embodiment, the evacuated sorbent assembly includes a vapor-permeable membrane that separates adjacent sorbent and liquid passageway sections whether or not the liquid passageway section contains wicking material.

Embodiments of the cooling device additionally include a liquid refrigerant reservoir, adjacent the liquid passageway section, and a casing that surrounds the sorbent section, the liquid passageway section, the vapor-permeable membrane, the liquid refrigerant reservoir, and the valve.

In addition to including a wicking material, other embodiments of the present invention include: a heat-removing material, which may be a phase-changing material, in thermal contact with the sorbent; at least one liquid barrier between the heat-removing material and the sorbent; and at least one thermal spacer positioned between the sorbent section and the liquid passageway section. In some embodiments, the thermal spacer is interposed between the sorbent section and the vapor-permeable membrane. In other embodiments, the thermal spacer is interposed between the vapor-permeable membrane and the liquid passageway section. Furthermore, some embodiments include casings made from a flexible material such as a metallicized plastic.

A feature of the present invention is that it is compact and lightweight. The invention is designed to fit within a host container, i.e., a beverage container. An additional feature of the invention, related to its compact size, is the short vapor path between the liquid refrigerant reservoir and the sorbent. The vapor path is at most several millimeters.

Other features and advantages of the present invention will be set forth, in part, in the description which follows and the accompanying drawings, wherein the preferred embodiments of the present invention are described and shown, and in part will become apparent to those skilled in the art upon examination of the following detailed description taken in conjunction with the accompanying drawings, or may be learned by practice of the present invention. The advantages of the present invention may be realized and attained by means of the instrumentalities and combinations particularly pointed out in the appended claims.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for claims and as a representative basis for teaching one skilled in the art to variously employ the present invention in virtually any appropriately detailed structure.

Certain terminology will be used in the following specification for convenience in reference only and will not be limiting. For example, the word "absorption" refers to the occurrence of a substance (e.g., water vapor) penetrating the inner structure of another(the absorbent). Also, the word "adsorption" refers to the occurrence of a substance (e.g., water vapor) being attracted and held onto the surface of another (the adsorbent). The words "absorption" and "adsorption" will includes derivatives thereof. The word "sorbent" refers to a material that is either an absorbent and/or an adsorbent.

Figure 1:
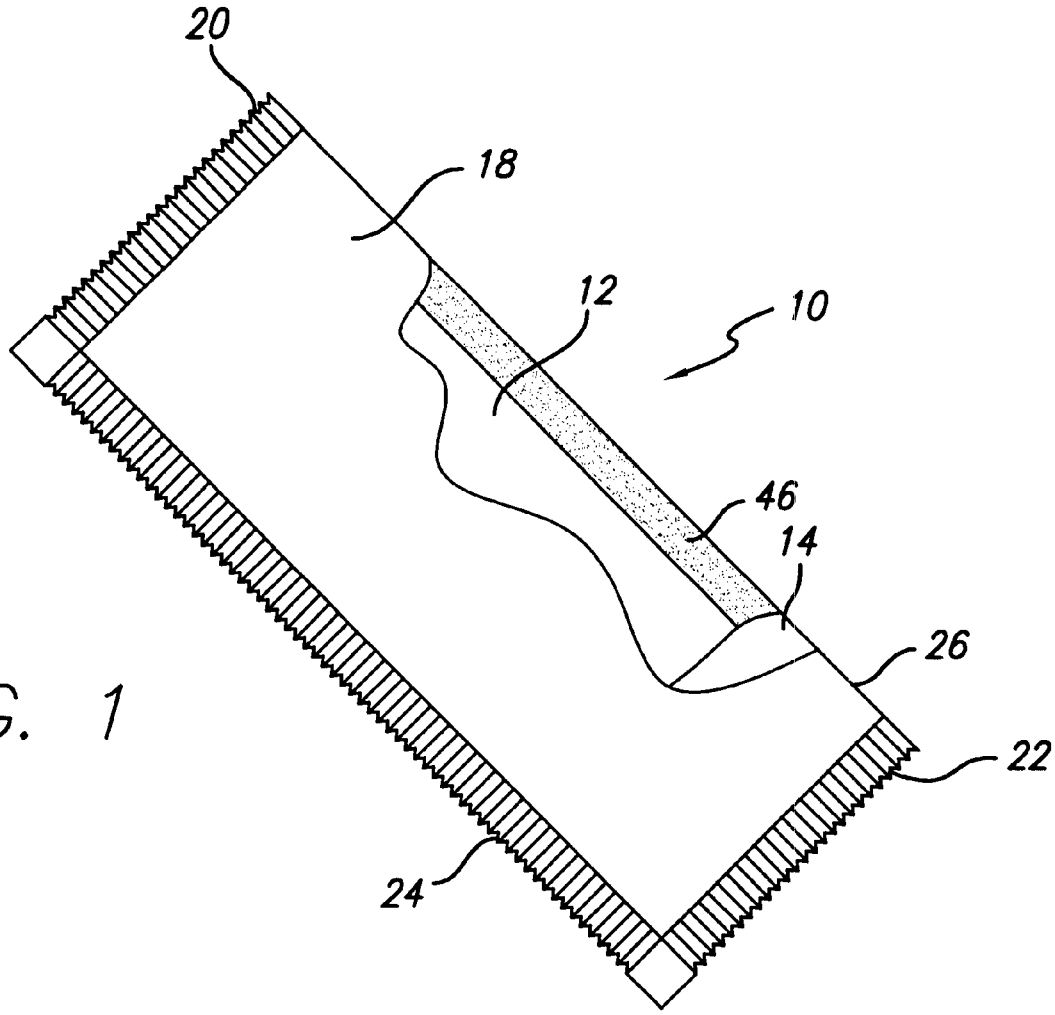
FIG. 1 is a top plan view, partially cut away, of a cooling device in accordance with the invention.
Figure 2:
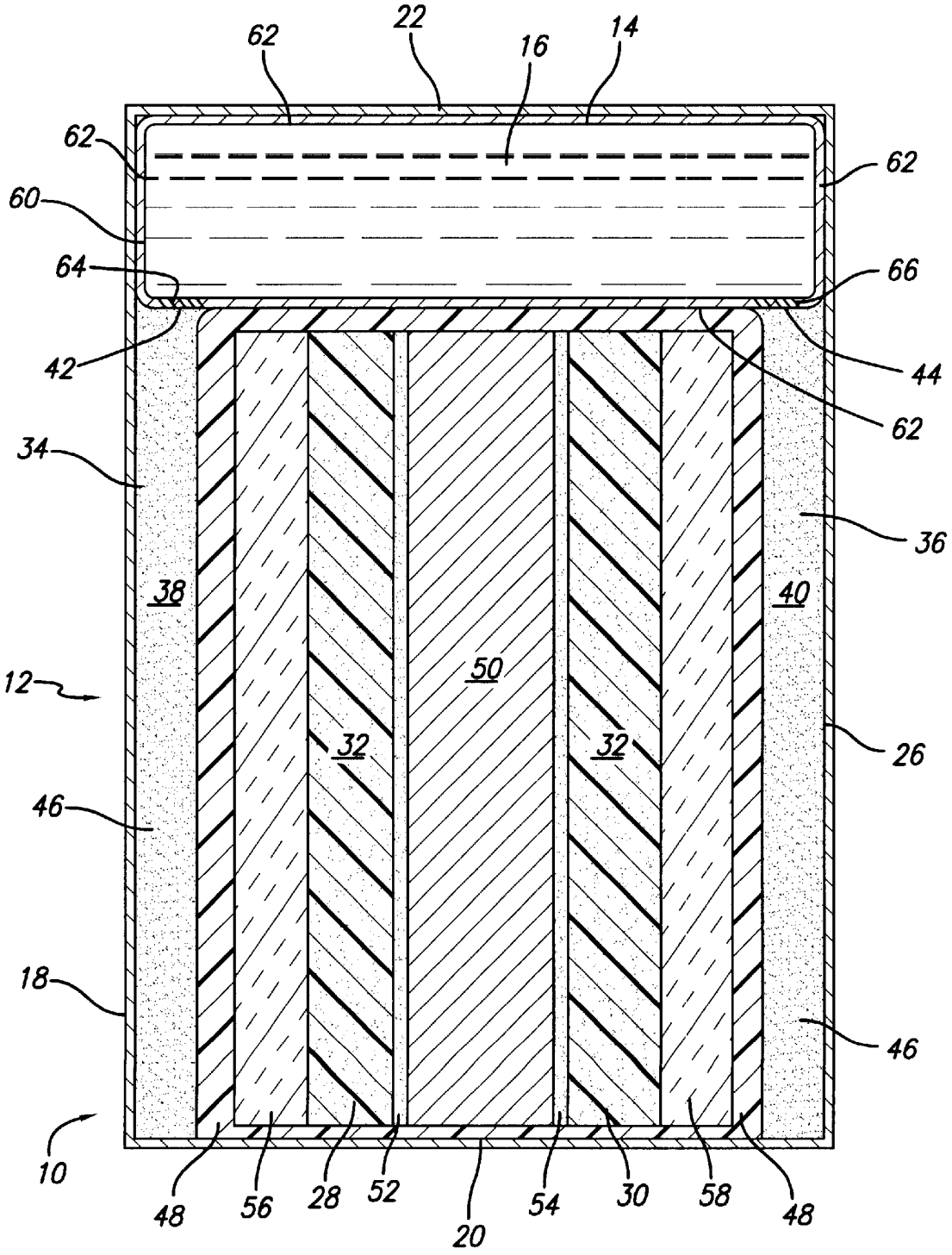
FIG. 2 is a sectional view of the cooling device of FIG. 1 showing details of a sorbent chamber and a liquid refrigerant reservoir.

The inventive, evacuated sorbent assembly and cooling device is shown in the exemplary drawings. With particular reference to FIGS. 1 and 2, there is shown a cooling device 10 housing an evacuated sorbent assembly 12 adjacent a liquid refrigerant reservoir 14, which contains a liquid refrigerant 16. The cooling device includes an evacuable casing 18, with opposing ends 20 and 22, and opposing sides 24 and 26. The casing is substantially impervious to air and moisture so as to provide the cooling device with a suitable shelf-life (to allow for several years of storage/inactivation prior to use). Useful casing materials have an oxygen transmission rate (OTR) preferably less than 1 $cm^3/m^2/day$, more preferably less than 0.1 $cm^3/m^2/day$, and most preferably less than 0.01 $cm^3/m^2/day$. The vapor transmission rate of useful casing materials is preferably less than 2 $g/m^2/day$, more preferably less than 1 $g/m^2/day$, and the most preferably less than 0.1 $g/m^2/day$.

The casing 18 is made from a flexible material such as a metallicized plastic laminate or a metal foil plastic laminate. Suitable casing materials include flexible films such as those produced by the Rexam Corporation located in Bedford Park, Ill., and Toyo Aluminum located in Osaka, Japan.

A sectional view of the cooling device 10 is shown in FIG. 2. Included in the evacuated sorbent assembly 12 are a pair of sorbent sections 28 and 30 in which a sorbent 32 is disposed. In the preferred embodiments, the amount of sorbent in the sorbent sections weighs less than 65 grams. The sorbent preferably includes an absorbent material dispersed on a porous support material. The porous support material preferably has a high pore volume, and therefore a high surface area, to accommodate the absorption of large amounts of liquid refrigerant 16 by the sorbent. The pore volume is expressed in units of volume per unit mass. The porous support material has a pore volume of at least about 0.8 cc/g, more preferably at least about 1 cc/g, and even more preferably at least about 1.5 cc/g.

In order to accommodate high absorption levels of liquid refrigerant 16, it is also important to control the average pore diameter and pore size distribution of the porous support material. The average pore diameter is preferably at least about 1 nanometer, and typically in the range from about 1 to about 20 nanometers. The pore diameter distribution is such that there are very few pores having a diameter of less than about 0.5 nanometers. The porous support material can be selected from virtually any material having the above-identified properties. Preferred materials for the porous support material include activated carbon and silica.

The porous support material can come in a variety of shapes and sizes selected for a particular application. For example, in some embodiments, the porous support material is comprised of small activated carbon pellets having a size in the range of from about 0.5 to 2 millimeters. In alternative embodiments, the porous support material is silica pellets having a size from about 0.25 to 0.5 millimeters. The size of the pellets can be selected to influence the rate at which liquid refrigerant 16 is absorbed. Larger pellets absorb liquid refrigerant vapor at a slower rate due to increased path length.

It is preferred that the absorbent material have a pore volume that is at least about 50 percent of the pore volume of the porous support material, and even more preferably at least about 66 percent of the pore volume of the porous support material. That is, it is preferred that if the pore volume of the porous support material is about 1.5 cc/g, then the pore volume of the absorbent material is preferably no less than about 0.75 cc/g, more preferably no less than about 1.0 cc/g.

When the liquid refrigerant 16 is water, the absorbent material is preferably capable of absorbing at least about 100 percent of its weight in water, more preferably at least about 150 percent of its weight in water and even more preferably at least about 200 percent of its weight in water. The amount of water that can be absorbed will also be influenced by the relative humidity and temperature.

Any suitable absorbent material can be used. Representative absorbent materials include absorbent salts such as calcium chloride, lithium chloride, lithium bromide, magnesium chloride, calcium nitrate, and potassium fluoride. Other suitable absorbent materials include phosphorous pentoxide, magnesium perchlorate, barium oxide, calcium oxide, calcium sulfate, aluminum oxide, calcium bromide, barium perchlorate, and copper sulfate. Furthermore, the absorbent material may contain combinations of two or more of these materials.

Adjacent to each sorbent section 28 and 30 are liquid passageway sections 34 and 36, respectively, defining liquid passageways 38 and 40, respectively, through at least a portion of the evacuated sorbent assembly 12. A pair of valves 42 and 44 control the flow of liquid refrigerant 16 from the liquid refrigerant reservoir 14 into the liquid passageway sections. In some embodiments, the valves are mechanically activated. In other embodiments the valves are pressure activated such that a change in pressure causes the valves to open and permit communication between the liquid refrigerant reservoir and the liquid passageway sections.

In some embodiments, wicking material 46 is placed within the liquid passageway sections 34 and 36. The wicking material draws liquid refrigerant 16 from the liquid refrigerant reservoir 14 and retains the liquid refrigerant for subsequent vaporization and adsorption by the sorbent 32. In addition, the wicking material absorbs any vaporized liquid refrigerant in the liquid passageway sections that re-condenses before reaching the sorbent. When the liquid refrigerant is water, wicking materials include: hydrophilic materials such as microporous metals, porous plastics (polyethylene, polypropylene), cellulose products, or other hygroscopic materials (sintered heat pipe material or glass paper).

Only the amount of wicking material 46 required to draw all of the liquid refrigerant 16 to be adsorbed is incorporated in the evacuated sorbent assembly 12. The wicking material has a pore size sufficient to permit capillary action (the drawing of all the liquid refrigerant from the liquid refrigerant reservoir 14) to occur within 60 seconds, and most preferably, within 10 seconds once the valves 42 and 44 open.

In some embodiments, the wicking material 46 provides a direct interface between the liquid refrigerant 16 and the sorbent 32. In these embodiments, the wicking material maintains and holds all of the liquid refrigerant until it is vaporized and later adsorbed by the sorbent. Sufficient wicking material is used so that non-vaporized liquid refrigerant does not directly contact the sorbent.

In other embodiments, a vapor-permeable membrane 48 separates sorbent sections 28 and 30 and adjacent liquid passageway sections 34 and 36. The vapor-permeable membrane is semi-permeable such that only vaporized liquid refrigerant 16 may pass through it to be adsorbed by the sorbent 32. In some embodiments, the vapor-permeable membrane is a substantially flat film that is heat-sealed or sealed by an adhesive so as to encase the sorbent and to prevent liquid from contacting the sorbent within the vapor-permeable membrane. Useful vapor-permeable membranes include semi-permeable films such as films available under the trademark TYVEK® produced by the DuPont Corporation located in Wilmington, Del., and films available under the trademark GORETEX® produced by the R.L. Gore Company located in Newark, Del. In other embodiments of the present invention, the vapor-permeable membrane is not substantially flat, but is corrugated or otherwise shaped so as to increase surface area and thereby the rate at which vaporized liquid refrigerant passes through the membrane.

Alternatively, the vapor-permeable membrane 48 is a hydrophobic coating applied to one or both of the adjacent surfaces of the sorbent sections 28 and 30 and the liquid passageway sections 34 and 36. Suitable hydrophobic coatings include those available under the trademark SCOTCHGARD® produced by 3M located in St. Paul, Minn.

In some embodiments, the evacuated sorbent assembly 12 also contains a heat-removing material 50 in thermal contact with the sorbent sections 28 and 30. The heat-removing material is placed adjacent to the surface of each sorbent section opposite the vapor-permeable membrane 48. The heat-removing material is one of three types: (1) a material that undergoes a change of phase when heat is applied (phase-change material); (2) a material that has a heat capacity greater than the sorbent 32; or (3) a material that undergoes an endothermic reaction when brought in contact with a vaporized liquid refrigerant 16. It will be understood by the skilled artisan that the heat-removing material, for use in a particular application may vary depending on the sorbent utilized, the thermal insulation, if any, between the phase-change material and the liquid refrigerant, and the desired cooling rate.

The heat-removing material 50 may be comprised of paraffin, naphthalene sulphur, hydrated calcium chloride, bromocamphor, cetyl alcohol, cyanamide, eleudic acid, lauric acid, hydrated calcium silicate, sodium thiosulfate pentahydrate, disodium phosphate, hydrated sodium carbonate, hydrated calcium nitrate, neopentyl glycol, hydrated inorganic salts including Glauber's salt, inorganic salts encapsulated in paraffin, hydrated potassium and sodium sulfate, and hydrated sodium and magnesium acetate. The preferred heat-removing material is an inorganic salt that has been melted and re-solidified to form a monolith (thereby reducing the volume of the heat-removing material by approximately 30%).

The heat-removing material 50 removes some of the heat from the sorbent sections 28 and 30 simply through the storage of sensible heat, because the heat-removing material heats up as the sorbent sections heat up, thereby removing heat from the sorbent sections. However, the most effective heat-removing material typically undergoes a change of phase. A large quantity of heat is absorbed in connection with a phase change (i.e., change from a solid phase to a liquid phase, change from a solid phase to part solid phase and part liquid phase, or change from a liquid phase to a vapor phase). During the phase change, there is typically little change in the temperature of the heat-removing material, despite the relatively substantial amount of heat absorbed to effect the change.

Another requirement of any phase-changing heat-removing material 50 is that it change phase at a temperature greater than the expected ambient temperature of the material to be cooled, but less than the temperature achieved by the sorbent sections 28 and 30 upon absorption of a substantial fraction (i.e., one-third or one-quarter) of the liquid refrigerant 16. For example, if the current invention is employed in a cooling device 10 for insertion into a typical beverage container, the phase change should take place at a temperature above about 30° C., preferably above about 35° C. but preferably below about 70° C., and most preferably below about 60° C.

When absorbing heat, a phase-changing heat-removing material 50 may generate by-products such as water, aqueous salt solutions, and organics (paraffins). Therefore, depending on the particular heat-removing material utilized, in some embodiments it is desirable to include liquid barriers 52 and 54, such as polyethlene or polypropylene film, interposed between the sorbent sections 28 and 30, respectively, and the heat-removing material to prevent any by-products from contacting the sorbent 32 (and thereby decreasing its effectiveness). The liquid barriers are heat sealed or adhesively sealed to the heat-removing material.

As there can be large temperature differences between the wicking material 46 and the sorbent sections 28 and 30, in some embodiments thermal spacers 56 and 58 are interposed between the sorbent sections and the vapor-permeable membranes 48 or between the sorbent sections and the wicking material. The thermal spacers are utilized to insulate heat generated by the sorbent 32. Since the temperature between the wicking material and sorbent sections can vary from 5° C. to 150° C., the thermal spacers have a thermal resistance (thermal conductivity at package conditions divided by thickness) preferably less than 100 $W/m^2K$, more preferably less than 50 $W/m^2K$, and most preferably less than 20 $W/m^2K$. The materials utilized for the thermal spacers can be selected from a range of materials known to the art that provide sufficient vapor permeability such as fiberglass, plastic fibers, and plastic foams.

The liquid refrigerant reservoir 14 is positioned immediately adjacent one end 22 of the casing 18. This arrangement provides an advantage over prior art sorbent chambers that typically employ devices with unnecessarily long vapor paths which decrease the effectiveness of the vaporization of the liquid refrigerant 16. In addition, the short vapor paths allow the evacuated sorbent assembly 12 to operate at a much higher pressure level than previous sorbent assemblies.

In some embodiments, the liquid refrigerant reservoir 14 is a plastic bag 60, typically made of polyethlene, that is filled and heat sealed along its edges 62 enclosing the liquid refrigerant 16. Weakened portions 64 and 66 of the plastic bag serve as pressure sensitive valves 42 and 44.

The liquid refrigerant 16 stored in the liquid refrigerant reservoir 14 has a high vapor pressure at ambient temperature so that a reduction of pressure will produce a high vapor production rate. In addition, the liquid refrigerant has a high heat of vaporization. The vapor pressure of the liquid refrigerant at 20° C. is preferably at least about 9 mm Hg, and more preferably is at least about 15 or 20 mm Hg. Suitable liquid refrigerants include; various alcohols, such as methyl alcohol or ethyl alcohol; ketones or aldehydes such as acetone and acetaldehyde; and hydrofluorocarbons such as C318, 114, 21, 11, 114B2, 113, 112, 134A, 141B, and 245FA. The preferred liquid refrigerant is water because it is plentiful and does not pose any environmental problems while providing the desired cooling characteristics. When the cooling device 10 is employed in a standard 12 ounce beverage can, the liquid refrigerant is preferably less than 13 grams of liquid water.

In some embodiments, the liquid refrigerant 16 is mixed with an effective quantity of a miscible nucleating agent (or a partial miscible nucleating agent) having a greater vapor pressure than the liquid refrigerant to promote ebullition so that the liquid refrigerant evaporates even more quickly and smoothly, while preventing the liquid refrigerant from supercooling and thereby decreasing the adsorption rate in the sorbent 32. Suitable nucleating agents include ethyl alcohol, acetone, methyl alcohol, isopropyl alcohol and isobutyl alcohol, all of which are miscible with water. For example, a combination of a nucleating agent with a compatible liquid might be a combination of 5% ethyl alcohol in water or 5% acetone in methyl alcohol. The nucleating agent preferably has a vapor pressure at 25° C. of at least about 25 mm Hg, and, more preferably, at least about 35 mm Hg. Alternatively, a solid nucleating agent may be used, such as a conventional boiling stone used in chemical laboratory applications.

During manufacturing, the sorbent sections 28 and 30 and valves 42 and 44 are inserted into the casing 18 along with the liquid refrigerant reservoir 14 prior to heat sealing the casing. Depending upon the embodiment, wicking material 46 is placed adjacent the sorbent sections and encased with a vapor-permeable membrane 48. Furthermore, in some embodiments, the vapor-permeable membrane also encases a layer of heat-removing material 50 in thermal contact with the sorbent 32, liquid barriers 52 and 54 interposed between the heat-removing material and the sorbent sections, respectively, and thermal spacers 56 and 58 interposed between the sorbent sections and the liquid passageway sections 34 and 36, respectively. Specifically, the thermal spacers may be interposed between the sorbent sections and the vapor-permeable membrane or between the vapor-permeable membrane and the liquid passageway sections. Next, the opposing ends 20 and 22 and at least one of the opposing sides 24 and 26 are heat sealed after evacuation to greater than 1 mm Hg. In alternative embodiments, the casing is sealed with an adhesive.

The method of use and operation of the evacuated sorbent assembly 12 and cooling device 10, constructed as described above, proceeds as follows. Initially, the valves 42 and 44 are actuated causing the liquid refrigerant 16 to flow into the liquid passageways 38 and 40. In the embodiments of the invention where the liquid refrigerant reservoir 14 is a plastic bag 60 with weakened portions 64 and 66, external pressure is applied to the casing 18 and liquid refrigerant reservoir. The external pressure ruptures the weakened portions and releases the liquid refrigerant into the liquid passageways.

Liquid refrigerant 16, except for a minute amount that is instantly vaporized, is introduced into the evacuated sorbent assembly 12 from the liquid refrigerant reservoir 14 via the liquid passageways 38 and 40. Depending upon the embodiment of the invention, the liquid refrigerant collects in very thin layers among the interstices of the wicking material 46. The vaporized liquid refrigerant then passes through the vapor-permeable membrane 48, and enters the sorbent sections 28 and 30 where the vaporized liquid refrigerant is adsorbed by the sorbent 32. As the sorbent adsorbs vaporized liquid refrigerant, the liquid refrigerant collected within the wicking material begins to vaporize and pass through the vapor-permeable membrane into the sorbent. Vaporization of the liquid refrigerant causes a cooling effect on the outside of the casing 18.

A feature of the present invention is that the vapor path is short compared to the prior art devices. This arrangement provides for a relatively compact configuration with short vapor paths and a high surface area to volume ratio thereby enabling increased rates of heat transfer. The short vapor path allows more liquid refrigerant 16 to be vaporized in a shorter amount of time.

Regarding all previously discussed embodiments of the present invention, as the cooling device 10 is encased in a flexible casing 18, the current arrangement does not require large, heavy, and expensively manufactured components. In addition, the flexibility of the cooling device allows it to be deformed without losing its performance characteristics. For example, the cooling device may be curled and then placed within a beverage container without any degradation in its cooling abilities.

Figure 3:
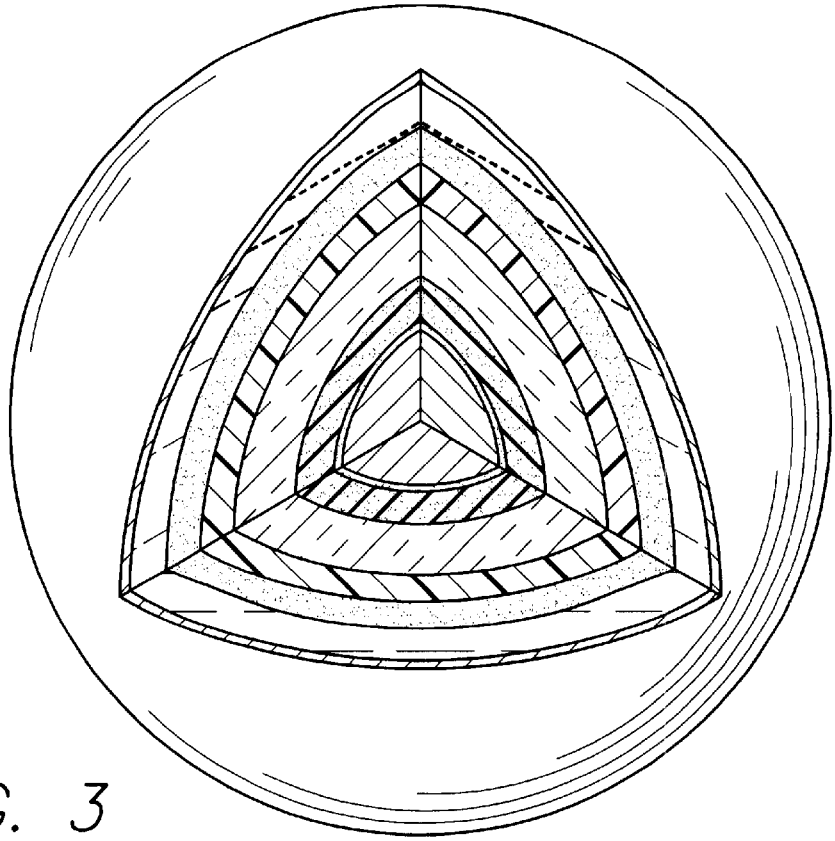
FIG. 3 is a perspective view, partially cut away, of an alternative embodiment of a cooling device in accordance with the invention.
Figure 4:
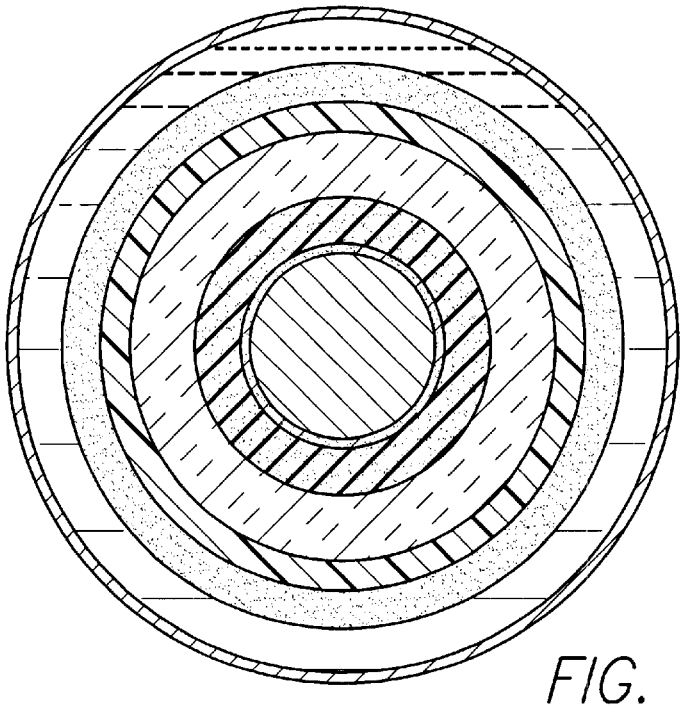
FIG. 4 is a sectional view of the cooling device of FIG. 3.
Figure 5:
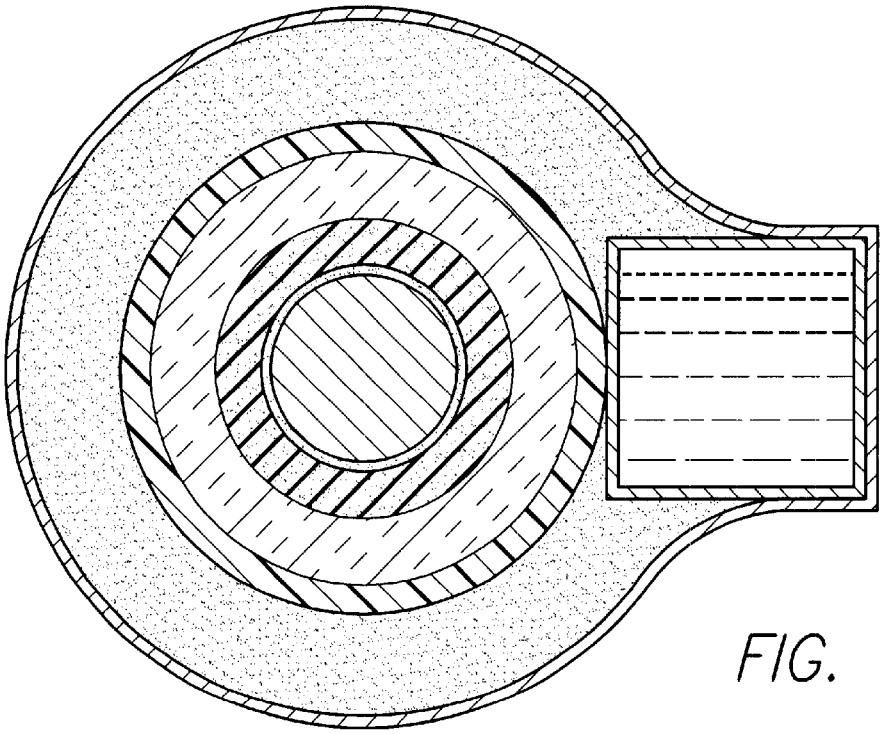
FIG. 5 is a sectional view of an alternative embodiment of a cooling device in accordance with the invention.
Figure 6:
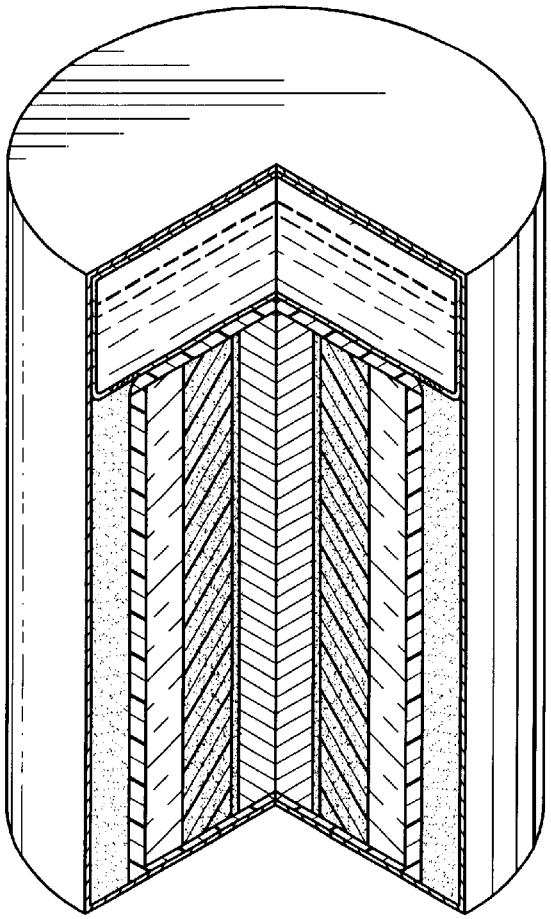
FIG. 6 is a perspective view, partially cut away, of another alternative embodiment of a cooling device in accordance with the invention.
Figure 7:
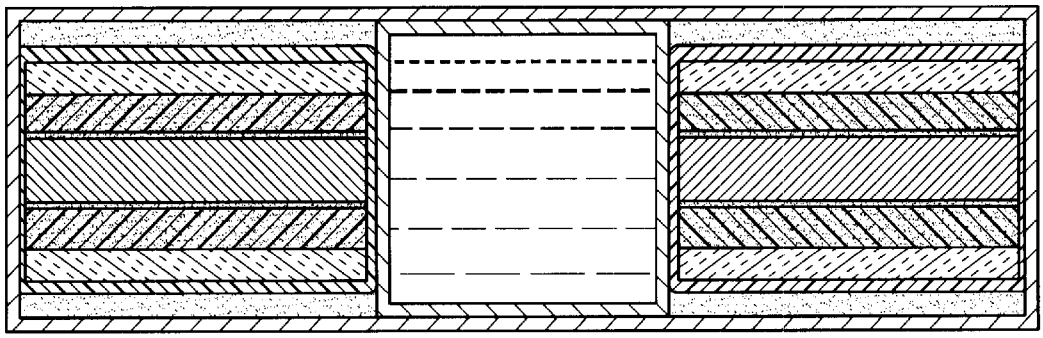
FIG. 7 is a sectional view of another alternative embodiment of a cooling device in accordance with the invention.
Figure 8:
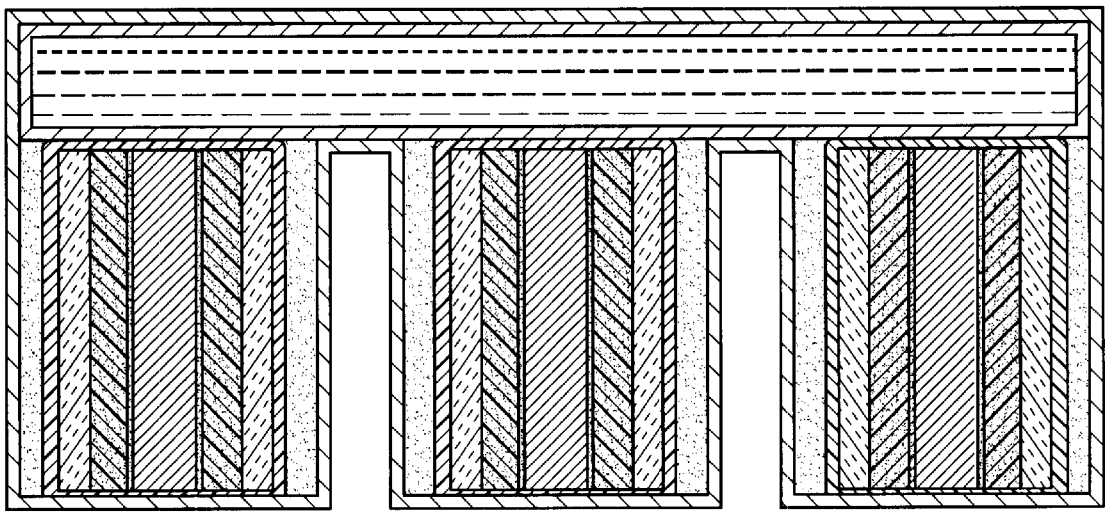
FIG. 8 is a sectional view of another alternative embodiment of a cooling device in accordance with the invention.

Those skilled in the art will recognize that various modifications and variations can be made in the evacuated sorbent assembly 12 and cooling device 10 of the invention and in the construction and operation of the evacuated sorbent assembly and cooling device without departing from the scope or spirit of this invention. For example, the evacuated sorbent assembly may be used as part of a cooling device which may be wrapped around the outer circumference of a beverage container rather than being placed therein. In addition, the cooling device need not be two-sided, but rather, it can be arranged such that the bottom layer adjacent the casing 18 is the sorbent section 28, with the next layer being a vapor-permeable membrane 48, and with the final layer of the evacuated sorbent assembly being the wicking material 46. Also, the evacuated sorbent assembly and cooling device can be arranged in a spherical configuration, as shown in FIGS. 3, 4, and 5. In FIGS. 3 and 4, the liquid refrigerant reservoir 14 surrounds a spherically-shaped evacuated sorbent assembly. In FIG. 5, the liquid refrigerant reservoir is adjacent a spherically-shaped evacuated sorbent assembly. FIG. 6 shows another embodiment of the present invention where the cooling device and evacuated sorbent assembly are cylindrical. In other embodiments, as shown in FIGS. 7 and 8, two or more evacuated sorbent assemblies are adjacent to a single liquid refrigerant reservoir. With such possibilities in mind, the invention is defined with reference to the following claims.

We claim:

1. A cooling device comprising:

a casing surrounding at least one sorbent section containing a sorbent for a liquid refrigerant;

at least one liquid passageway section adjacent the sorbent section, the liquid passageway section defining a liquid passageway through at least a portion of the cooling device to the sorbent section;

at least one wicking material disposed in the liquid passageway section;

at least one thermal spacer in contact with the sorbent section;

a vapor-permeable membrane interposed between the liquid passageway section and the thermal spacer;

a heat-removing material in thermal contact with the sorbent;

at least one liquid barrier interposed between the heat-removing material and the sorbent;

a liquid refrigerant reservoir adjacent the liquid passageway section; and a valve for controlling liquid communication between the liquid passageway section and the liquid refrigerant reservoir.

2. The cooling device of claim 1, wherein the heat-removing material is a phase-change material.

3. The cooling device of claim 1, wherein the casing is made from a flexible metallicized plastic.

4. A cooling device comprising:

a casing surrounding at least one sorbent section containing a sorbent for a liquid refrigerant;

at least one liquid passageway section adjacent the sorbent section, the liquid passageway section defining a liquid passageway through at least a portion of the cooling device to the sorbent section;

a vapor-permeable membrane separating adjacent sorbent and liquid passageway sections;

a liquid refrigerant reservoir adjacent the liquid passageway section; and a valve for controlling liquid communication between the liquid passageway section and the liquid refrigerant reservoir.

5. The cooling device of claim 4, further comprising a heat-removing material in thermal contact with the sorbent and surrounded by the casing.

6. The cooling device of claim 5, wherein the heat-removing material is a phase-change material.

7. The cooling device of claim 5, further comprising at least one liquid barrier interposed between the heat-removing material and the sorbent and surrounded by the casing.

8. The cooling device of claim 4, further comprising at least one wicking material disposed in the liquid passageway section.

9. The cooling device of claim 4, further comprising at least one thermal spacer interposed between the sorbent section and the vapor-permeable membrane and surrounded by the casing.

10. The cooling device of claim 4, further comprising at least one thermal spacer interposed between the vapor-permeable membrane and the liquid passageway section and surrounded by the casing.

11. The cooling device of claim 4, wherein the casing is made from a flexible material.

12. The cooling device of claim 11, wherein the flexible material is metallicized plastic.

* * * * *